US009707658B2

(12) United States Patent
Darcangelo et al.

(10) Patent No.: US 9,707,658 B2
(45) Date of Patent: Jul. 18, 2017

(54) EDGE FINISHING APPARATUS

(71) Applicant: Corning Incorporated, Corning, NY (US)

(72) Inventors: Charles Michael Darcangelo, Corning, NY (US); Steven Edward DeMartino, Painted Post, NY (US); Aric Bruce Shorey, Webster, NY (US); Daniel Duane Strong, Hector, NY (US); David Alan Tammaro, Painted Post, NY (US); Butchi Reddy Vaddi, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 14/793,093

(22) Filed: Jul. 7, 2015

(65) Prior Publication Data

US 2015/0306726 A1 Oct. 29, 2015

Related U.S. Application Data

(63) Continuation of application No. 13/169,499, filed on Jun. 27, 2011, now Pat. No. 9,102,030.
(Continued)

(51) Int. Cl.
*B24B 31/112* (2006.01)
*B24B 29/00* (2006.01)
(Continued)

(52) U.S. Cl.
CPC ..... *B24B 31/112* (2013.01); *B24B 1/005* (2013.01); *B24B 9/065* (2013.01); *B24B 21/002* (2013.01); *B24B 29/00* (2013.01); *B24B 37/00* (2013.01)

(58) Field of Classification Search
CPC ..... B24B 1/005; B24B 21/002; B24B 29/00; B24B 31/112; B24B 37/00; B24B 9/065; B24B 31/116; B24B 37/042
(Continued)

(56) References Cited

U.S. PATENT DOCUMENTS 3,520,091 A * 7/1970 Osmond ..... B24B 9/14 451/240
3,834,089 A 9/1974 Barnett
(Continued)

FOREIGN PATENT DOCUMENTS

CN 101249637 A 8/2008
CN 101352826 A 1/2009
(Continued)

OTHER PUBLICATIONS

TW100124267 Search Report dated Sep. 10, 2015.
(Continued)

*Primary Examiner* — Joseph J Hail
*Assistant Examiner* — Marc Carlson

(57) ABSTRACT

An edge finishing apparatus includes a surface, a fluid delivery device configured to deliver at least one magneto-rheological polishing fluid (MPF) ribbon to the at least one well, at least one magnet placed adjacent to the surface to selectively apply a magnetic field in a vicinity of the surface, and at least one holder placed in opposing relation to the surface, the at least one holder being configured to support at least one article such that an edge of the at least one article can be selectively immersed in the MPF ribbon delivered to the at least one well.

18 Claims, 7 Drawing Sheets

Related U.S. Application Data

(60) Provisional application No. 61/362,969, filed on Jul. 9, 2010.

(51) Int. Cl.

| | |
|---|---|
| ***B24B 21/00*** | (2006.01) |
| ***B24B 1/00*** | (2006.01) |
| ***B24B 9/06*** | (2006.01) |
| ***B24B 37/00*** | (2012.01) |

(58) Field of Classification Search

USPC ..... 451/36, 43, 364

IPC ..... B24B 1/005,21/002, 29/00, 31/112, B24B 37/00, 9/065

See application file for complete search history.

(56) References Cited

U.S. PATENT DOCUMENTS

| | | | | |
|---|---|---|---|---|
| 4,549,370 | A | 10/1985 | Makedonski et al. | |
| 4,821,466 | A | 4/1989 | Kato et al. | |
| 5,339,569 | A | 8/1994 | Piggen | |
| 5,490,809 | A | 2/1996 | Jones et al. | |
| 5,616,066 | A * | 4/1997 | Jacobs | B24B 1/005 451/113 |
| 5,795,212 | A | 8/1998 | Jacobs et al. | |
| 5,804,095 | A * | 9/1998 | Jacobs | B24B 1/005 106/3 |
| 5,839,944 | A | 11/1998 | Jacobs et al. | |
| 5,951,369 | A | 9/1999 | Kordonski et al. | |
| 6,267,651 | B1 | 7/2001 | Kordonski et al. | |
| 6,322,428 | B1 | 11/2001 | Kondo | |
| 6,325,704 | B1 | 12/2001 | Brown et al. | |
| 6,358,118 | B1 | 3/2002 | Boehm et al. | |
| 6,500,056 | B1 | 12/2002 | Krusell et al. | |
| 6,506,102 | B2 | 1/2003 | Kordonski et al. | |
| 6,612,904 | B1 | 9/2003 | Boehm et al. | |
| 6,663,719 | B2 | 12/2003 | Shinozaki et al. | |
| 6,749,491 | B1 | 6/2004 | Gotkis et al. | |
| 6,769,969 | B1 | 8/2004 | Duescher | |
| 6,921,455 | B1 * | 7/2005 | Nakano | B24B 1/005 156/345.11 |
| 6,955,589 | B2 | 10/2005 | Kordonski et al. | |
| 6,969,307 | B2 | 11/2005 | Kiermasz | |
| 6,991,521 | B2 | 1/2006 | Hagan et al. | |
| 7,238,092 | B2 | 7/2007 | Basol et al. | |
| 7,520,800 | B2 | 4/2009 | Duescher | |
| 7,670,206 | B2 | 3/2010 | Togawa et al. | |
| 7,887,396 | B2 | 2/2011 | Laursen et al. | |
| 7,959,490 | B2 | 6/2011 | Sutton | |
| 8,062,098 | B2 | 11/2011 | Duescher | |
| 8,449,347 | B2 | 5/2013 | Sutton | |
| 8,613,640 | B2 | 12/2013 | Kordonski et al. | |
| 2002/0123298 | A1 | 9/2002 | Krusell et al. | |
| 2003/0060020 | A1 | 3/2003 | Walitzki et al. | |
| 2004/0089322 | A1 | 5/2004 | Shinozaki et al. | |
| 2004/0266319 | A1 | 12/2004 | Kordonski et al. | |
| 2005/0070212 | A1 | 3/2005 | Pham et al. | |
| 2008/0064301 | A1 | 3/2008 | Birang et al. | |
| 2008/0076330 | A1 | 3/2008 | Birang et al. | |
| 2011/0171568 | A1 | 7/2011 | Sasaki et al. | |
| 2011/0275286 | A1 | 11/2011 | Menapace et al. | |
| 2012/0302139 | A1 * | 11/2012 | Darcangelo | B24B 9/08 451/36 |
| 2013/0260651 | A1 | 10/2013 | Wan et al. | |

FOREIGN PATENT DOCUMENTS

| | | | |
|---|---|---|---|
| CN | 101559571 | A | 10/2009 |
| EP | 0703847 | B1 | 4/2002 |
| JP | 58132455 | A | 8/1983 |
| JP | 64016369 | A | 1/1989 |
| JP | 2006000962 | A | 1/2006 |
| JP | 2010082746 | A | 4/2010 |
| TW | 520318 | | 2/2003 |
| WO | 9714532 | | 4/1997 |

OTHER PUBLICATIONS

Nishiyama et al.; "Dynamic Response of Magneto-Rheological Fluid Channel Flow with Fluid-Wall Interactions"; Journal of Physics: Conference Series 149 (2009); pp. 1-4.

Fox et al.; "Magnetic Abrasive Finishing of Rollers"; Annals of the CIRP vol. 43/1/1994; pp. 181-184.

Khairy; "Aspects of surface and edge finish by magnetoabrasive particles"; Journal of Materials Processing Technology 116 (2001); pp. 77-83.

Kordonski et al.; "Fundamentals of Magnetorheological Fluid Utilization in High Precision Finishing"; Journal of Intelligent Material Systems and Structures, vol. 10 (1999); pp. 683-689.

Slater; "Intelligent Lens Polishing With MRF"; Image Technology, BKSTS, Long, GB, vol. 82, No. 1 (Feb. 2000); XP-00894122.

JP2015238329 Office Action Dated Dec. 6, 2016, Japan Patent Office.

English Translation of CN201510626484.5 First Office Action Dated Mar. 3, 2017, China Patent Office.

* cited by examiner

EDGE FINISHING APPARATUS

This application is a continuation of and claims the benefit of priority to U.S. patent application Ser. No. 13/169,499, filed on Jun. 27, 2011, which claims the benefit of priority under 35 U.S.C. §119 of U.S. Provisional Application Ser. No. 61/362,969, filed on Jul. 9, 2010, the contents of which are relied upon and incorporated herein by reference in their entireties.

BACKGROUND

Field

Embodiments relate to an apparatus for finishing the edges of articles, especially articles formed of brittle materials. More specifically, embodiments relate to an apparatus for finishing an edge of an article using magnetorheological polishing fluid (MPF).

Technical Background

Glass sheets have been cut by mechanical or laser separation. Mechanical separation leaves the cut glass sheet with a rough and/or sharp edge that makes the cut glass sheet vulnerable to cracking, and likely undesirable for certain applications. In practice, the roughness or sharpness has to be removed, typically by a series of mechanical grinding and polishing steps. Abrasive rotational grinding tools are used to mechanically remove roughness and/or sharpness from edges. Typically, the abrasive rotational grinding tools are metal grinding wheels containing micron-sized abrasive particles, e.g., micron-sized diamond particles. Mechanical polishing can be by a metal, vitrified or polymer wheel, and may or may not employ loose abrasive particles. The mechanism of material removal using the abrasive grinding tools is typically considered to involve fracture. As such, the larger the size of abrasive particles in the grinding tool, the larger the fracture sites that remain on the edge of the glass sheet after grinding. These fracture sites effectively become stress concentration and fracture initiation sites, which result in a finished glass sheet having a lower strength than the parent glass sheet. Grinding tools with smaller abrasives and/or polishing tools can be used to reduce the size of the fracture sites. It is possible to avoid roughness in the edge by using laser separation to cut the glass sheet. However, the laser-separated glass sheet would still have a sharp edge. Typically, a series of steps involving coarse and fine abrasive tools is used to remove the sharpness from the edge. In practice, several polishing steps are typically needed to remove the sharpness, which can significantly increase the cost of finishing the glass sheet. U.S. Pat. No. 6,325,704 (Brown et al.) discloses a system in which a plurality of grinding wheels and polishing wheels are used to simultaneously grind and polish the edge of a glass sheet.

SUMMARY

One embodiment is an edge finishing apparatus comprising a surface having at least one well formed therein, a fluid delivery device configured to deliver a magnetorheological polishing fluid (MPF) ribbon to the at least one well, at least one magnet placed adjacent to the surface to selectively apply a magnetic field in a vicinity of the surface, and at least one holder placed in opposing relation to the surface, the at least one holder being configured to support at least one article such that an edge of the at least one article can be selectively immersed in the MPF ribbon delivered to the at least one well.

Another embodiment is an edge finishing apparatus comprising a surface on which a first surface area and a second surface area are defined, a polishing media supported on the first surface area, and at least a first holder placed in opposing relation to the first surface area, the first holder being configured to support at least a first article such that an edge of the at least a first article can selectively contact the polishing media. The edge finishing apparatus further includes a fluid delivery device configured to deliver at least one MPF ribbon to the second surface area, at least one magnet placed adjacent to the second surface area to selectively apply a magnetic field in a vicinity of the second surface area, and at least a second holder placed in opposing relation to the second surface area, the at least a second holder being configured to support at least a second article such that an edge of the at least a second article can be selectively immersed in the at least one magnetorheological fluid ribbon.

Another embodiment is an edge finishing apparatus comprising at least one flat surface, a fluid delivery device configured to deliver at least one MPF ribbon to the at least one flat surface, at least one magnet disposed adjacent to the at least one flat surface to apply a magnetic field in a vicinity of the at least one flat surface, and at least one holder disposed in opposing relation to the at least one flat surface, the at least one holder being configured to support at least one article such that an edge of the at least one article can be selectively immersed in the at least one MPF delivered to the at least one flat surface. Flat, in one embodiment, is substantially flat. Some irregularities or non smooth areas may be present on one or more surfaces of the article.

Another embodiment is an edge finishing apparatus comprising at least two surfaces, a fluid delivery device configured to deliver a magnetorheological polishing fluid (MPF) ribbon to the surfaces, at least one magnet placed adjacent to the surface to selectively apply a magnetic field in a vicinity of the surfaces, and at least one holder placed in opposing relation to each of the surfaces, the at least one holder being configured to support at least one article such that an edge of the at least one article can be selectively immersed in the MPF ribbon delivered to the surfaces.

These and other embodiments are described in detail below.

BRIEF DESCRIPTION OF DRAWINGS

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Figure 1:
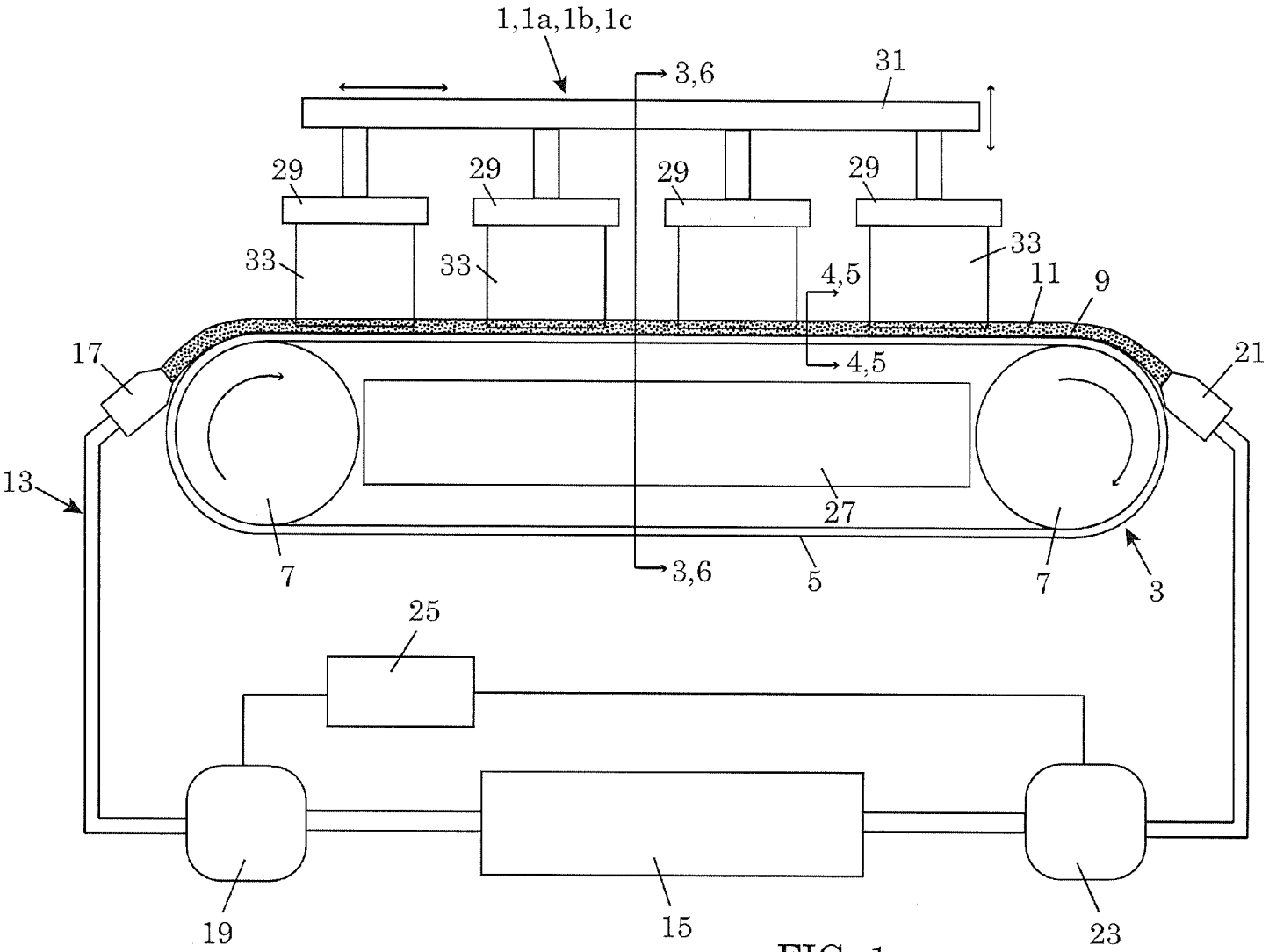
FIG. 1 is a schematic of an edge finishing apparatus.

In the following detailed description, numerous specific details may be set forth in order to provide a thorough understanding of embodiments of the invention. However, it will be clear to one skilled in the art when embodiments of the invention may be practiced without some or all of these specific details. In other instances, well-known features or processes may not be described in detail so as not to unnecessarily obscure the invention. In addition, like or identical reference numerals may be used to identify common or similar elements.

A process for making edge-finished articles starts with providing an article. Typically, the article is made of a brittle material. Examples of brittle materials include glasses, glass-ceramics, ceramics, silicon, semiconductor materials, and combinations of the preceding materials. In one embodiment, the article comprises a green glass, a thermally tempered glass, an ion-exchanged glass, or the like. The article may be a two-dimensional article or a three-dimensional article. The process may include cutting the article, for example, into a desired shape or size or a plurality of articles. Cutting may be implemented using any suitable process, such as mechanical separation, for example, scoring; laser separation; or ultrasonic separation.

After the providing step or cutting step, the article may have a rough and/or sharp edge—the roughness and/or sharpness would need to be removed. Herein, the term "edge" of an article refers to the circumferential edge or perimeter (the article can be of any shape and is not necessarily circular) of the article or internal edge, such as in holes or slots. The edge may have a straight profile, a curved profile, or a contoured profile, or the edge may have edge portions, where each edge portion has a straight profile, a curve profile, or a contoured profile. The article may be subjected to an edging process in which the shape and/or texture of the edge is modified by removing material from the edge. Any of a number of processes may be employed in the edging process, e.g., abrasive machining, abrasive jet machining, chemical etching, ultrasonic polishing, ultrasonic grinding, and chemical-mechanical polishing, to name a few. The edging process may be completed in one step or in a series of steps.

After the edging step, the process includes finishing the edge of the article. In one or more embodiments, finishing includes polishing the edge of the article using a magnetorheological polishing fluid (MPF). A method of finishing an edge of an article using a MPF is described in U.S. patent application Ser. No. 13/112,498 filed on May 20, 2011, the disclosure of which is incorporated herein by reference. Various configurations of MPFs are possible. In general, a MPF includes magnetic particles (e.g., carbonyl iron, iron, iron oxide, iron nitride, iron carbide, chromium dioxide, low-carbon steel, silicon steel, nickel, cobalt, and/or a combination of the preceding materials), non-magnetic abrasive particles (e.g., cerium oxide, silicon carbide, alumina, zirconia, diamond, and/or a combination of the preceding materials), a liquid vehicle (e.g., water, mineral oil, synthetic oil, propylene glycol, and/or ethylene glycol), surfactants, and stabilizers to inhibit corrosion. Application of a magnetic field to the MPF causes the magnetic particles in the fluid to form chains or columnar structures that increases the apparent viscosity of the MPF, changing the MPF from a liquid state to a solid-like state. The edge of the article is polished by immersing the edge into the magnetically-stiffened MPF while imparting a relative motion between the edge of the article and the stiffened fluid. The magnetically-stiffened MPF removes fractures and subsurface damage while polishing, thereby increasing the edge strength of the article. The article may also be strengthened by other processes, e.g., by ion-exchange, prior to or after finishing the edge of the article.

FIGS. 1-7 show an edge finishing apparatus 1 (and its variants 1*a*, 1*b*, 1*c*, 1*d*) for magnetorheological finishing of an edge of an article or edges of a plurality of articles. Variants 1*a*, 1*b*, 1*c* of the edge finishing apparatus 1 are indicated in FIG. 1 along with the edge finishing apparatus 1. This is because the edge finishing apparatus 1 and its variants 1*a*, 1*b*, 1*c* appear identical in the view shown in FIG. 1. Additional views (FIGS. 4-6) will be used to show the differences between the edge finishing apparatus 1 and its variants 1*a*, 1*b*, 1*c*.

In one embodiment, in FIG. 1, the edge finishing apparatus 1 includes a flat conveyor belt 3 having a continuous loop of flat belt 5 on rollers 7. The rollers 7 are rotated by a suitable driver (not shown separately). The continuous loop of flat belt 5 provides a flat surface 9 for carrying a MPF ribbon 11. Although the surface 9 is described as flat, it should be noted that features such as wells may be formed in the surface 9 to carry MPF or other polishing media. Also, the flat surface 9 may have a complex contour that allows the edge of the article to be finished to be shaped to a complex degree. To carry the MPF ribbon 11, the flat surface 9 may be made of a material that is non-wetting when in contact with the MPF ribbon 11. The flat surface 9 may be a moving or movable surface, e.g., by virtue of the continuous loop of flat belt 5 moving on the rollers 7 or by supporting the flat surface 9 on another motion device.

The edge finishing apparatus 1 includes at least one magnet 27 for generating a magnetic field in the vicinity of and along the length of the flat surface 9. The generated magnetic field is applied to the MPF ribbon 11 on the flat surface 9 in order to stiffen the MPF ribbon 11, as explained above, for a polishing process. The magnet 27 may be an electromagnet or a permanent magnet. To avoid distortion of the generated magnetic field, the flat surface 9 may be made of a non-magnetic material. In general, one or more magnets, which may be electromagnets or permanent magnets, may be used to generate the magnetic field. (FIG. 2 shows apparatus 1 with a plurality of magnets 28 for generating the magnetic field that is applied to the MPF ribbon 11.)

The edge finishing apparatus 1 includes a fluid circulation system 13, which delivers MPF to one end of the flat surface 9 and collects MPF from another end of the flat surface 9. The MPF delivered to the flat surface 9 by the fluid circulation system 13 runs along the flat surface 9 in the form of a ribbon, hence the term MPF ribbon 11. In general, the fluid circulation system 13 includes a fluid tank 15 containing an amount of MPF. The fluid circulation system 13 includes a delivery nozzle 17 for delivering MPF from the fluid tank 15 to one end of the flat surface 9. A pump 19 may assist in the fluid delivery. The fluid circulation system 13 includes a collection device 21 for collecting MPF from another end of the flat surface 9. A pump 23 may assist in the fluid collection. The collected fluid is returned to the fluid tank 15, which may be equipped with fluid conditioners, such as a filtration system for filtering unwanted particles from the returned MPF. The fluid circulation system 13 includes a control system 25 for controlling delivery and collection of MPF. Not identified separately, but implicitly included in the fluid circulation system 13, are fluid lines used to deliver and collect fluid and controllers, e.g., valves, used to control flow rates and pressures in the fluid lines.

Figure 3:
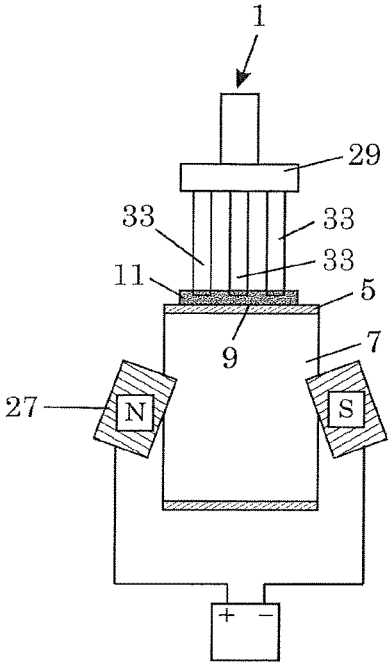
FIG. 3 is a cross-section of FIG. 1 along line 3-3.

The edge finishing apparatus 1 includes holders 29 arranged in opposing relation to the flat surface 9. The holders 29 are coupled to a translation device (or robot) 31. The translation device (or robot) 31 provides the holders 29 with translational motion along a first direction parallel to the flat surface 9 (i.e., parallel to a length of the surface 9) and along a second direction orthogonal to the flat surface 9. Alternatively, it is possible to provide each holder 29 with its own dedicated translation device (or robot). Each holder 29 holds one or more articles 33. FIG. 3 shows a cross section of a portion of apparatus 1 with a holder 29 holding one or more articles 33. Each holder 29 may have one or a plurality of slots with retainers for receiving and gripping the one or more articles 33.

Figure 2:
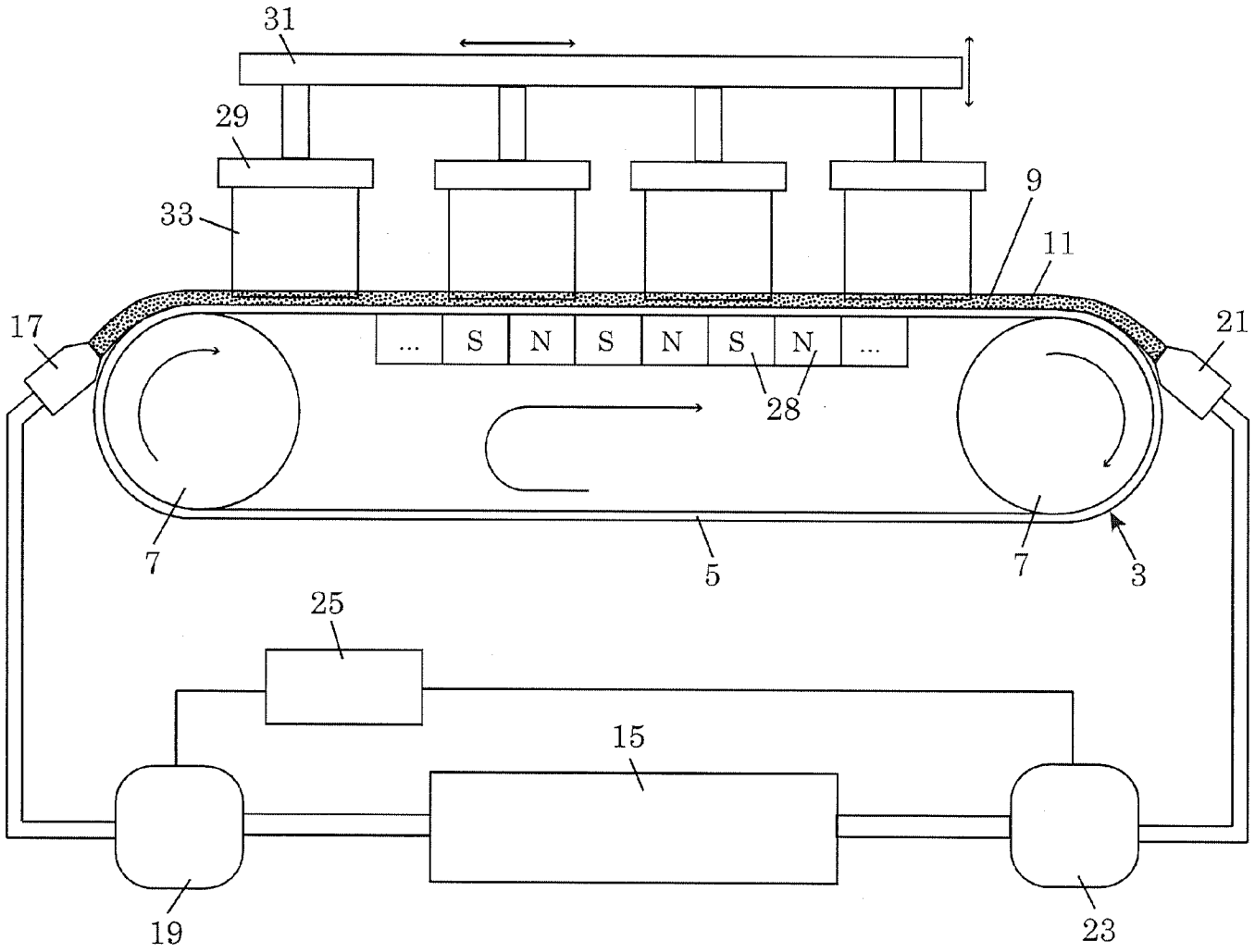
FIG. 2 is a schematic of the edge finishing apparatus of FIG. 1 with a plurality of magnets.

In FIG. 1 or 2, using the translation device 31, the holders 29 can be adjusted vertically (i.e., along a direction orthogonal to the surface 9) so that edges of the articles 33 can be immersed in the MPF ribbon 11 in order to allow polishing of the edges of the articles 33 using the MPF ribbon 11. In one or more embodiments, the holders 29 hold the one or more articles 33 so that edges (or edge portions) to be finished are parallel to the flow direction of the MPF ribbon 11. In one or more embodiments, the holders 29 hold the one or more articles 33 so that edges (or edge portions) to be finished traverse collinear with the flow direction of the magnetorheological polishing fluid ribbon 11. Finishing of the edges of the articles 33 is accomplished by immersing the edges into the MPF ribbon 11, stiffening the MPF ribbon 11, and affecting a relative motion between the edges of the articles 33 and the MPF ribbon 11. The relative motion can be affected by moving the holders 29 relative to the flat surface 9, by moving the flat surface 9 relative to the holders 29, or by moving the holders 29 and flat surface 9 relative to each other. The magnetically-stiffened MPF ribbon 11 has the ability to conform to the local shape of the edges of the articles 33 while polishing the edges. Therefore, the edges can have any suitable profiles as previously mentioned.

Figure 4:
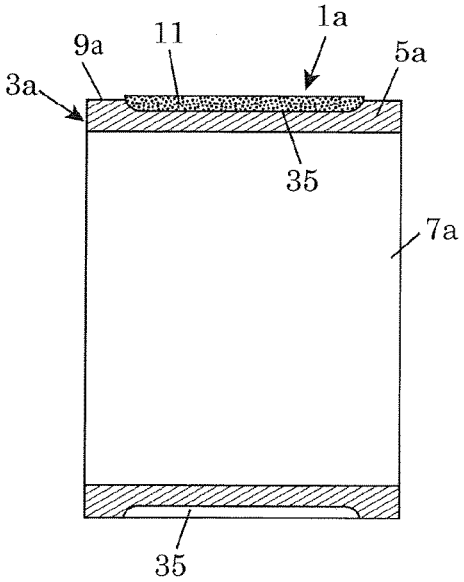
FIG. 4 is a cross-section of FIG. 1 along line 4-4 showing a well for a MPF ribbon.

FIG. 4 shows a cross-section of apparatus 1*a*. Relative to FIG. 1, this cross-section of apparatus 1*a* would be taken along line 4-4. Apparatus 1*a* is apparatus 1 as described above with the specific modifications that will be described below. The suffix "a" will be used to identify the parts of apparatus 1*a* that are modified relative to apparatus 1. Apparatus 1*a* includes a well 35 formed in the flat surface 9*a*. The flat surface 9*a* may be provided by a continuous loop of flat belt 5*a* of a flat belt conveyor 3*a*, as described for the flat surface 9 above. In one embodiment, the well 35 is formed as a continuous channel in the continuous loop of flat belt 5*a*. The well 35 can have a wide U-shape as shown in FIG. 4 or may have other trough-like shapes capable of holding fluid.

Figure 5:
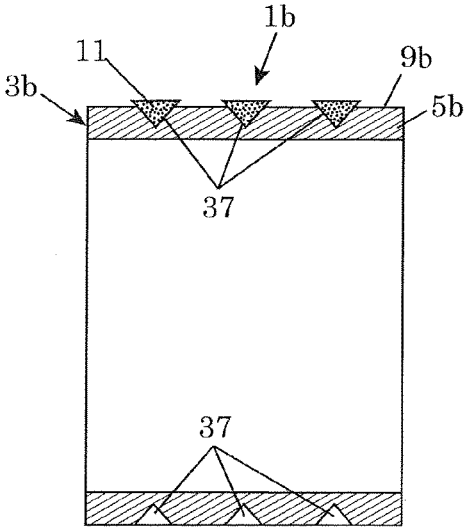
FIG. 5 is a cross-section of FIG. 1 along line 5-5 showing a plurality of wells for a plurality of MPF ribbons.

FIG. 5 shows a cross-section of apparatus 1*b*. Relative to FIG. 1, this cross-section would be taken along line 5-5. Apparatus 1*b* is apparatus 1 as described above with the specific modifications that will be described below. The suffix "b" will be used to identify the parts of apparatus 1*b* that are modified relative to apparatus 1. Apparatus 1*b* includes multiple wells 37 formed in the flat surface 9*b*. In this example, the wells 37 have a V-shape. The magnetic pole pieces may be set up so that each well has its on magnetic field applied (i.e. there would be N and S pole pieces shown in FIG. 3 for each of the wells shown in FIG. 5). The flat surface 9*b* in which the wells 37 are formed may be provided by a continuous loop of flat belt 5*b* of a flat conveyor belt 3*b*, as described for the flat surface 9 above. In one embodiment, the wells 37 are formed as continuous channels in the continuous loop of flat belt 5*b*. The wells 47 may have triangular shapes as shown or other trough-like shapes capable of holding fluid. Each of the wells 37 can receive a MPF ribbon 11, thereby allowing a plurality of MPF ribbons 11 to be carried by the flat surface 9*b* simultaneously, each MPF ribbon defining a polishing zone for edge(s) of article(s). The fluid circulation system (13 of FIG. 1) may be configured to deliver a plurality of streams of MPF to the flat surface 9*b* so as to form the plurality of MPF ribbons 11. For example, the fluid circulation system (13 of FIG. 1) may have multiple delivery nozzles (17 of FIG. 1) for delivering the multiple streams of MPF to the flat surface 9*b* or the wells in the flat surface 9*b*.

Figure 6:
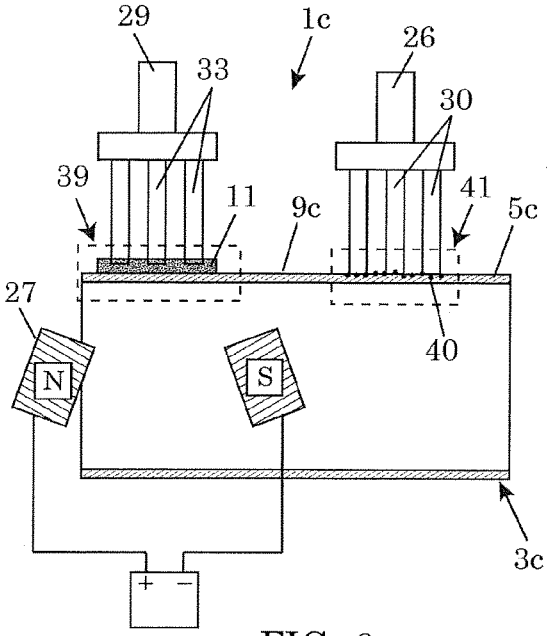
FIG. 6 is a cross-section of FIG. 1 along line 6-6 showing multiple finishing zones.

FIG. 6 shows a cross-section of apparatus 1*c*. Relative to FIG. 1, this cross-section would be taken along line 6-6. Apparatus 1*c* is apparatus 1 as described above with the specific modifications that will be described below. The suffix "c" will be used to identify the parts of apparatus 1*c* that are modified relative to apparatus 1. In apparatus 1*c*, two zones (or surface areas) 39, 41 are defined on the flat surface 9*c*. Polishing using MPF ribbon 11 occurs in zone 39, and polishing using a conventional polishing media 40 occurs in zone 41. Examples of conventional polishing media include polymeric pads with non-magnetic abrasives and abrasive belts or pads. A holder 29 supports the articles 33 for polishing of the articles 33 with the MPF ribbon 11, and holder 26 supports the articles 30 for polishing of the articles 30 with the polishing media 40. Translation devices may be appropriately provided to move the holders 29, 26 relative to the flat surface 9*c*. Apparatus 1*c* allows two different types of polishing to be accomplished simultaneously using the same apparatus. The zones 39, 41 may be arranged in parallel, as shown in FIG. 6, or may alternatively be arranged in series along the length of the flat surface 9*c*. The flat surface 9*c* may be provided by a continuous loop of flat belt 5*c* of a flat belt conveyor 3*c*, as described for the flat surface 9 above.

Figure 7:
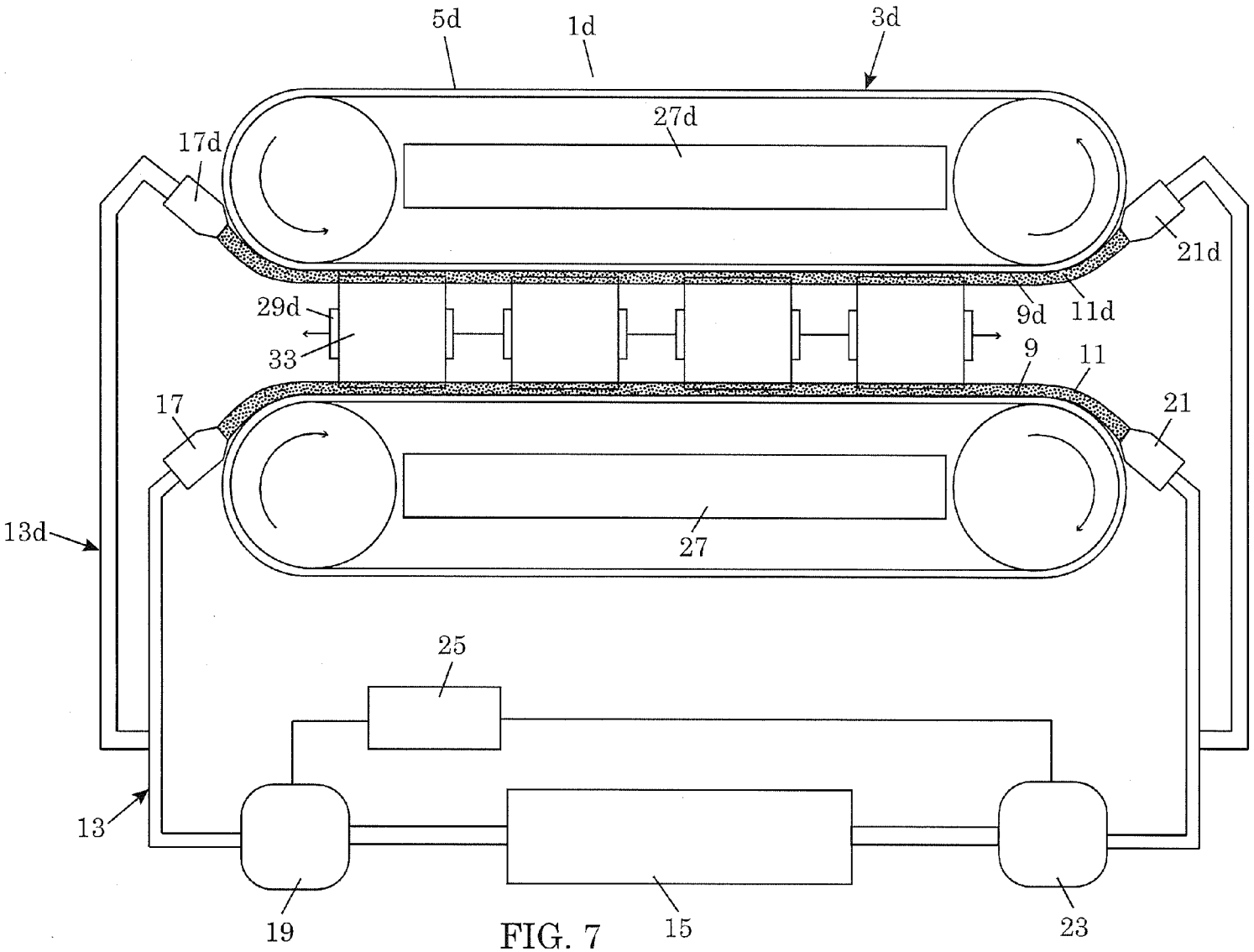
FIG. 7 is a schematic of an edge finishing apparatus with opposed surfaces for carrying MPF ribbons.

FIG. 7 shows an edge finishing apparatus 1*d*. Apparatus 1*d* is apparatus 1 as described above with the specific modifications that will be described below. The suffix "d" will be used to identify the parts of apparatus 1*d* that are modified or added on relative to apparatus 1. A second flat surface 9*d* is arranged opposite to the first flat surface 9. The second flat surface 9*d* may be provided by a continuous loop of flat belt 5*d* of a flat conveyor 3*d* as explained above for the flat surface 9. Holders 29*d* support the articles 33 between the flat surfaces 9, 9*d*. Magnets 27, 27*d* generate magnetic fields in the vicinity of and along the length of the flat surfaces 9, 9*d*, respectively. The fluid circulation system 13*d* includes the previously described fluid circulation system 13 (made up of members 17, 21, 19, 25, 15, 23) for delivering MPF ribbon(s) 11 to the flat surface 9 and collecting MPF from the flat surface 9. The fluid circulation system 13*d* further includes a delivery nozzle 17*d* for delivering MPF ribbon(s) 11*d* to the flat surface 9*d* and a collection device 21*d* for collecting MPF from the flat surface 9*d*, where the delivery nozzle 17*d* and collection device 21*d* are in communication with the fluid circulation system 13. Wells can be formed in the flat surface 9*d* as described above for the flat surfaces 9*a*, 9*b* (in FIGS. 4 and 5) to receive one or more MPF ribbons. The arrangement shown in FIG. 7 allows the opposite edge portions of the articles 33 to be polished simultaneously by the MPF ribbon(s) 11 on the flat surface 9 and by the MPF ribbon(s) 11*d* on the flat surface 9*d*. A suitable translation device may be coupled to the holders 29*d* to move the holders 29*d* relative to the flat surfaces 9, 9*d* while the opposite edge portions of the articles 33 are being polished. Flat, in one embodiment, is substantially flat. Some irregularities or non smooth areas may be present on one or more surfaces of the article.

Figure 8:
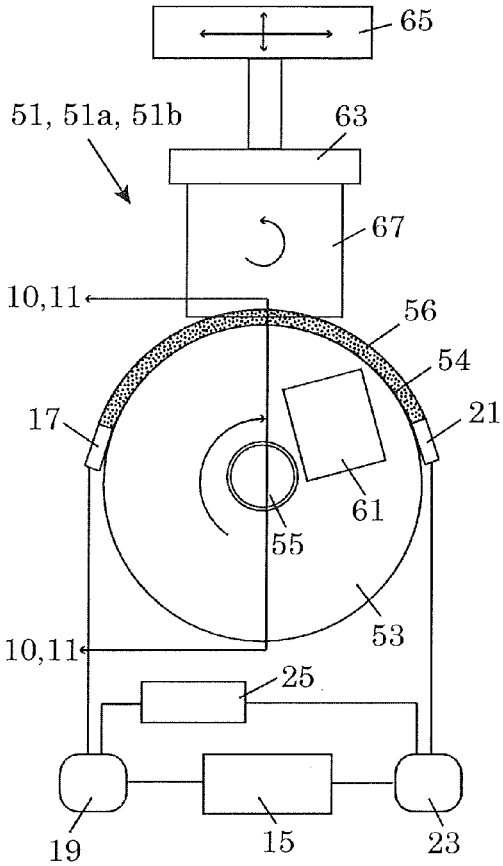
FIG. 8 is a schematic of an edge finishing apparatus.

FIGS. 8-11 depict an edge finishing apparatus 51 (and its variants 51*a*, 51*b*) for magnetorheological finishing of an edge of an article or edges of a plurality of articles. Variants 51*a*, 51*b* of the edge finishing apparatus 51 are indicated in FIG. 8 along with the edge finishing apparatus 51. This is because the edge finishing apparatus 51 and its variants 51*a*, 51*b* appear identical in the schematic shown in FIG. 8. Additional views (FIGS. 10-11) will be used to show the differences between the edge finishing apparatus 51 and variants 51*a*, 51*b*.

In FIG. 8, the edge finishing apparatus 51 includes a rotatable cylindrical wheel 53. For example, rotation of the cylindrical wheel 53 may be achieved by mounting the cylindrical wheel 53 on a spindle 55 that is attached to a suitable driver (57 in FIG. 9). The cylindrical wheel 53 provides a cylindrical surface 54 for carrying a MPF ribbon 56. The fluid circulation system 13 (previously described in relation to FIG. 1) is used to deliver MPF onto the cylindrical surface 54 and to collect MPF from the cylindrical surface 54. One or more magnets 61 are provided to apply a magnetic field in the vicinity of and along the cylindrical surface 54 in order to stiffen the MPF ribbon 56 for polishing purposes. A holder 63 is supported in opposing relation to the cylindrical surface 54. The holder 63 may be coupled to a translation device 65 capable of moving the holder 63 along a tangent direction to the cylindrical surface 54 (the tangent direction is a line tangent to the top of the cylindrical surface 54, i.e., the horizontal direction in FIG. 8). One or more articles 67 are supported by the holder 63. The position of the holder 63 relative to the cylindrical surface 54 can be adjusted in an orthogonal direction of the cylindrical surface 54 (the orthogonal direction is a line orthogonal to the top of the cylindrical surface 54, i.e., the vertical direction in FIG. 8), e.g., using the translation device 65, such that the edges of the articles 67 are immersed in the MPF ribbon 56. During the polishing process, translation of the holder 63 relative to the cylindrical surface 54 allows full contact between the entire length of the edges (or edge portions) of the articles 67 in opposing relation to the cylindrical surface 54 and the MPF ribbon 56 on the cylindrical surface 54.

Figure 9:
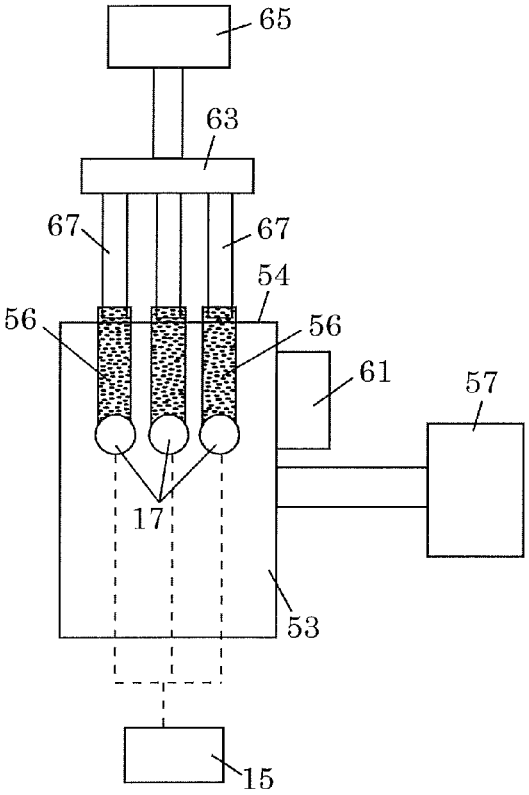
FIG. 9 is a side view of the edge finishing apparatus of FIG. 8.

FIG. 9 shows that a plurality of MPF ribbons 56 could be delivered to the cylindrical surface 54 via delivery nozzles 17, where each MPF ribbon 56 could be assigned to polish one of the plurality of sheets 67.

Figure 10:
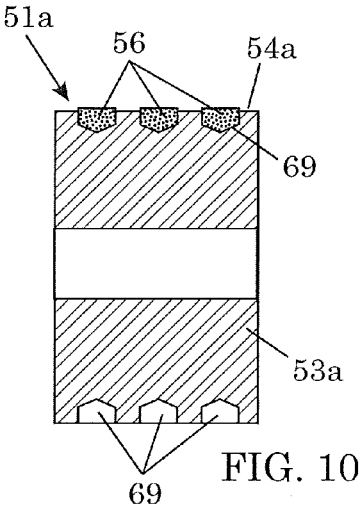
FIG. 10 is a cross-section of FIG. 8 along line 10-10 and shows multiple wells formed in a cylindrical surface of the edge finishing apparatus.

FIG. 10 shows a cross-section of apparatus 51*a*. Relative to FIG. 8, this cross-section would be taken along line 10-10. Apparatus 51*a* is apparatus 51 as described above with the specific modifications that will be described below. The suffix "a" will be used to identify the parts of apparatus 51*a* that are modified relative to apparatus 51. Wells (or channels) 69 are formed in the cylindrical surface 54*a* to receive the MPF ribbons 56 (in FIG. 9). The wells 69 wrap around the circumference of the cylindrical surface 54*a*.

Figure 11:
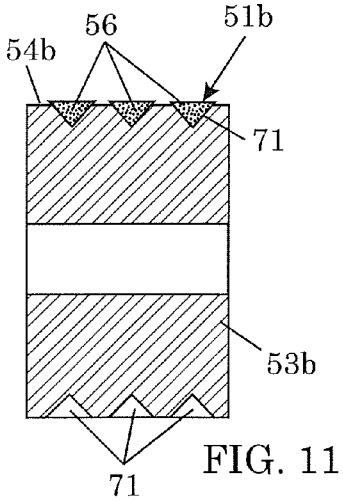
FIG. 11 is a cross-section of FIG. 8 along line 11-11 and shows multiple wells formed in a cylindrical surface of the edge finishing apparatus.

FIG. 11 shows a cross-section of apparatus 51*b*. Relative to FIG. 8, this cross-section would be taken along line 11-10. Apparatus 51*b* is apparatus 51 as described above with the specific modifications that will be described below. The suffix "b" will be used to identify the parts of apparatus 51*b* that are different from those of apparatus 51. Wells (or channels) 71 are formed in the cylindrical surface 54*b* to receive the MPF ribbons 56 (in FIG. 9). The wells 71 wrap around the circumference of the cylindrical surface 54*b*. FIG. 11 differs from FIG. 10 only in the shape of the wells 69, 71.

In any of the embodiments described above, the holder that supports one or more articles may also be configured to rotate the articles it supports so that the entire edges of the articles (including any corners) can be brought into contact with the MPF ribbon(s) during the polishing process without having to first unload the articles, change the orientation of the articles, and mount the articles back in the holder. FIG. 8 shows rotation of article 67, for example. The holder may be equipped with any suitable mechanism for rotating articles(s) relative to the surface carrying the MPF ribbon(s). Examples include, but are not limited to, a one-sided vacuum chuck, a pinching system with two rotating axles mounted on a C-frame configuration, and robotic manipulators that can grab the articles at the edges and rotate the articles.

In any of the embodiments described above, the MPFs delivered to multiple wells can be different, resulting in different polishing characteristics, e.g., different material removal rates.

In any of the embodiments described above, the magnetic field generated need not be stationary but may be capable of moving together with the MPF ribbon. In one embodiment, this can be achieved by attaching the magnet(s) to the surface carrying the MPF ribbon. In another embodiment, this is achieved by providing the magnet(s) with a translation device whose motion can be synchronized with that of the MPF ribbon. With a moving magnetic field, the magnetic field strength can be increased. Magnetic fields can be modulated to affect material removal behavior of the edge of the article and/or wear of the belt surface and/or to develop complex contours and shapes.

In conventional MRF configurations, there is a gradient in the magnetic field. This means the field intensity near the wheel surface (bottom of the MPF ribbon) is greater than that away from the wheel surface (top of the MPF fluid ribbon). Interferometric data has shown that the roughness along the centerline of the article edge is much better than along the periphery of the edge, which is consistent with the fact that the periphery of the edge is further away from the magnet, and where the field intensity is relatively low. Therefore, it is expected that the removal rate would be significantly lower in this region. Since this is the primary region that is tested during horizontal 4-point bend tests, the fact that it is typically an underpolished region (relative to a center line) can explain high variability seen in strength testing. This phenomenon led to embodiments of the apparatus described herein including, for example, the use of wells and/or grooves in wheels or belts, additional magnets and/or magnet placement, tilting or angling of the article(s), and/or tilting of one or more wheels.

Figure 13A:
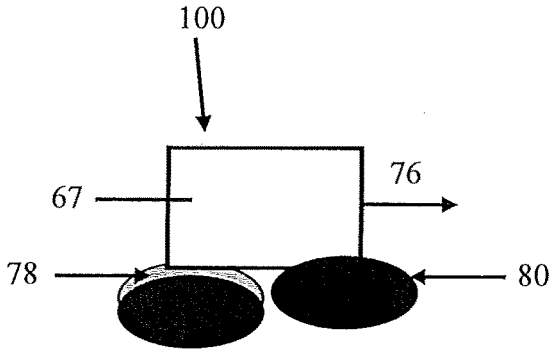
FIG. 13A and FIG. 13B are schematics of features of an edge finishing apparatus.
Figure 13B:
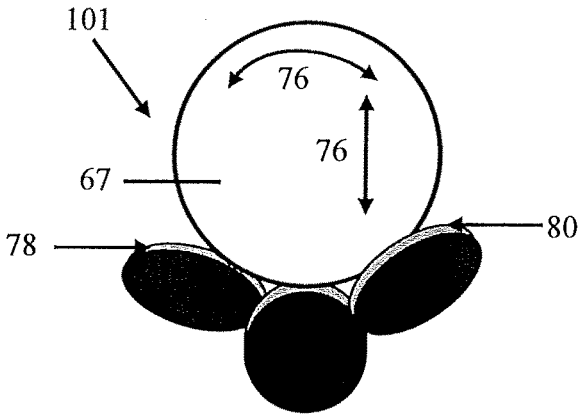

Better performance might be expected if the edge of the article were polished at an angle such that this region of the part edge is in the centerline of the flow. If true, one could imagine a configuration of MRF edge finishing apparatus, with features 100 and 101 as shown in FIGS. 13A and 13B, respectfully. The features shown in FIGS. 13A and 13B are modification or additions to the features of the apparatus shown in FIG. 8 and other embodiments described above. The edge finishing apparatus comprises at least two surfaces 78 and 80, a fluid delivery device configured to deliver a magnetorheological polishing fluid (MPF) ribbon to the surfaces, at least one magnet placed adjacent to the surface to selectively apply a magnetic field in a vicinity of the surfaces, and at least one holder placed in opposing relation to each of the surfaces, the at least one holder being configured to support at least one article such that an edge of the at least one article 67 can be selectively immersed in the MPF ribbon delivered to the surfaces. In one embodiment, a wheel or multiple wheels are arranged at an angle relative to the article face to enhance the polishing performance along the periphery of the article edge. An additional wheel in normal orientation in series may be added to the apparatus to finish the centerline if necessary. FIG. 13A shows an article being conveyed through the wheels, but the wheels could also be configured to move around the part. Finally, there could be any number of wheels simultaneously finishing one or all of the sides of one or multiple articles.

Figure 14:
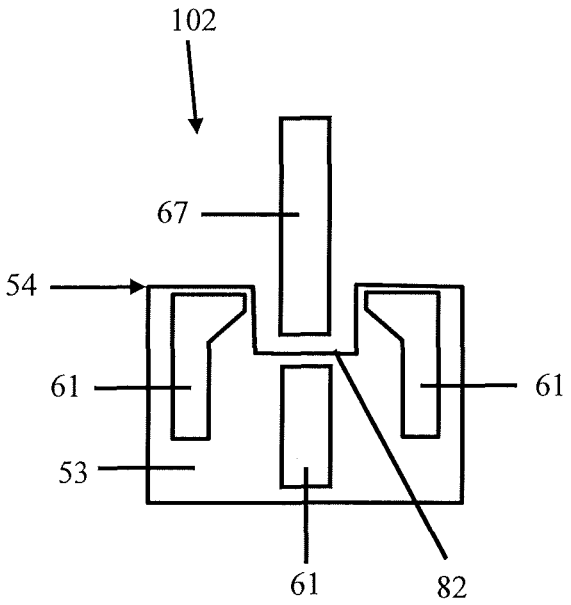
FIG. 14 is a cross-section schematic of features of an edge finishing apparatus.

FIG. 14 is a cross-section schematic of features 102 of an edge finishing apparatus. In one embodiment, the surface 54 of the wheel 53 comprises one or more grooves 82. This could allow the placement of magnets 61, such as magnet pole pieces, closer to the work zone so that the edges of the article 67 see higher, more uniform magnetic field intensity or to design pole pieces such that the glass edge sees uniform magnetic field intensity to ensure all parts of the edge are uniformly polished. An additional embodiment, as shown in FIG. 14, could include a combination of both. Adding a third magnet pole piece, as shown in FIG. 14, could maintain the advantages given by a gradient magnetic field while making it better suited for finishing edges of parts. Finally, one could imagine a situation where configurations exist in multiple areas along the periphery of the wheel.

One or all of the above embodiments could be applied to tilting or angling of the article(s), for example, an article or multiple articles can be arranged at an angle relative to a wheel surface or multiple wheel surfaces to enhance the polishing performance along the periphery of the article edge. Multiple articles, in one embodiment, can be arranged at the same or different angles relative to one or more wheel or belt surfaces.

One or all of the above embodiments could be applied to round articles (e.g. wafers). It is possible to employ an MRF wheel with a larger diameter than the diameter of the article. Also, it is possible to employ an MRF wheel with a smaller diameter than the diameter of the article to finish special features on an article edge. This could be done in series or in parallel in a separate work station.

Figure 12:
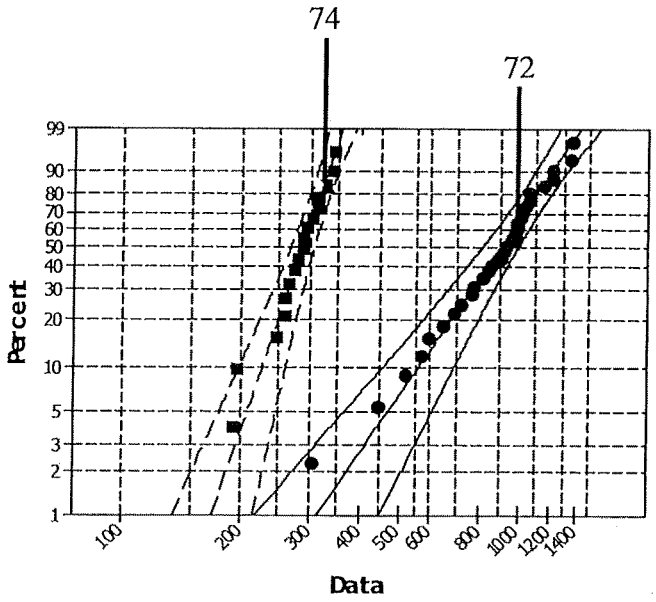
FIG. 12 is a graph comparing the edge strength of mechanically finished edges and MRF finished edges made using an exemplary apparatus.

High strength glass edges were produced using a magnetorheological finishing (MRF) apparatus as shown by data 72 in FIG. 12 to show the process optimization for high strength edges using MRF methods as described herein. The data is shown in megapascals (MPa), for example, B10 equals 561 MPa. 10 of the 30 data points for the high strength glass edges made according to the exemplary MRF methods are greater than 1 gigapascal (GPa). The process included a surface treatment to minimize surface flaw related breaks, protective coating on the surface for mechanical grinding, and soft MRF chuck contacts to minimize handling and finishing flaws. Data 74 in FIG. 12 demonstrates the best mechanical results as input coupled with Data 72 in FIG. 12 representing the best to-date MRF output results for edge strength. The exemplary MRF methods now produce a significant population of edge strengths equivalent to glass surface strengths.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An edge polishing apparatus comprising:

at least one holder being configured to support at least one article having at least one edge;

at least a first belt having at least a first flat surface;

at least a second belt having at least a second flat surface;

the first flat surface being arranged opposite to the second flat surface, with at least one article located therebetween;

a first and a second magnetorheological polishing fluid (MPF) ribbon respectively delivered to the at least first and second belts, wherein the first and second MPF ribbons are respectively conveyed to the at least first and the at least second flat surfaces;

at least one magnet disposed adjacent to the at least first and second belts to apply a magnetic field in a vicinity of the at least first and second flat surfaces;

wherein the at least one holder is configured to support at least one article such that the at least one edge of the at least one article can be simultaneously immersed in the at least one MPF ribbon on the first flat surface and the at least one MPF ribbon on the second flat surface such that at least the first flat surface and the second flat surface can be used to simultaneously polish the at least one edge on opposite sides of the at least one article.

2. The edge finishing apparatus of claim 1, wherein the at least first and second flat surfaces are each independently provided by a continuous loop of belt.

3. The edge finishing apparatus of claim 1, further comprising a translation device coupled to the at least one holder, the translation device being operable to translate the at least one holder relative to the at least first and second flat surfaces along at least one of a direction orthogonal to the at least first and second flat surfaces and a direction parallel to the at least first and second flat surfaces.

4. The edge finishing apparatus of claim 1, wherein the fluid delivery device is configured to deliver a plurality of MPF ribbons to the at least first and second belts.

5. The edge finishing apparatus of claim 1, further comprising another magnet disposed adjacent to the first and second belts to apply a second magnetic field in a vicinity of the first and second flat surfaces.

6. The edge finishing apparatus of claim 1, comprising two fluid delivery devices, the first fluid delivery device configured to deliver at least one MPF ribbon to the first belt and the second fluid deliver device configured to deliver at least one MPF ribbon to the second belt.

7. An edge polishing apparatus comprising:

at least one holder being configured to support at least one article having at least one edge;

at least a first belt having at least a first flat surface and comprising a first continuous channel formed therein;

at least a second belt having at least a second flat surface;

at least first and second belts, the first belt being arranged opposite to the second belt, with the at least one article located therebetween;

a first and a second magnetorheological polishing fluid (MPF) ribbon respectively delivered to the first continuous channel and the second belt, wherein the first and second MPF ribbons are respectively delivered by at least one fluid delivery device and wherein the first and second MPF ribbons are respectively conveyed to the at least first and second flat surfaces;

at least one magnet disposed adjacent to the at least first and second belts to apply a magnetic field in a vicinity of the at least first and second flat surfaces;

wherein the at least one holder is configured to support at least one article such that the at least one edge of the at least one article can be simultaneously immersed in the at least one MPF ribbon in the first continuous channel formed in the first belt and the at least one MPF ribbon on the second flat surface, such that at least the MPF ribbon in the first continuous channel formed in the first belt and the MPF ribbon on the second belt can be used to simultaneously polish the at least one edge on opposite sides of the at least one article.

8. The edge finishing apparatus of claim 7, wherein the at least first and second flat surfaces are each independently provided by a continuous loop of belt.

9. The edge finishing apparatus of claim 7, further comprising a translation device coupled to the at least one holder, the translation device being operable to translate the at least one holder relative to the at least first and second flat surfaces along at least one of a direction orthogonal to the at least first and second flat surfaces and a direction parallel to the at least first and second flat surfaces.

10. The edge finishing apparatus of claim 7, wherein the first belt comprises multiple first continuous channels, and the fluid delivery device is configured to deliver a plurality of MPF ribbons to the first continuous channels and second flat surface.

11. The edge finishing apparatus of claim 7, further comprising another magnet disposed adjacent to the at least first and second belts to apply a second magnetic field in a vicinity of the first and second flat surfaces.

12. The edge finishing apparatus of claim 7, comprising two fluid delivery devices, the first fluid deliver device configured to deliver at least one MPF ribbon to the first continuous channel and the second fluid deliver device configured to deliver at least one MPF ribbon to the second belt.

13. An edge polishing apparatus comprising:

at least one holder being configured to support at least one article having at least one edge;

at least a first belt having at least a first flat surface and comprising a first continuous channel formed therein;

at least a second belt having at least a second flat surface and comprising a second continuous channel formed therein;

at least first and second belts, the first belt being arranged opposite to the second belt, with the at least one article located therebetween;

a first and a second magnetorheological polishing fluid (MPF) ribbon respectively delivered to the first and second continuous channels, wherein the first and second MPF ribbons are respectively delivered by at least one fluid delivery device and wherein the first and second MPF ribbons are respectively conveyed to the at least first and second flat surfaces;

at least one magnet disposed adjacent to the at least first and second belts to apply a magnetic field in a vicinity of the at least first and second flat surfaces;

wherein the at least one holder is configured to support at least one article such that the at least one edge of the at least one article can be simultaneously immersed in the first and second MPF ribbons in the first and second continuous channels, such that at least the MPF ribbon in the first continuous channel formed in the first belt and the MPF ribbon in the second continuous channel formed in the second belt can be used to simultaneously polish the at least one edge on opposite sides of the at least one article.

14. The edge finishing apparatus of claim 13, wherein the at least first and second flat surfaces are each independently provided by a continuous loop of belt.

15. The edge finishing apparatus of claim 13, further comprising a translation device coupled to the at least one holder, the translation device being operable to translate the at least one holder relative to the at least first and second flat surfaces along at least one of a direction orthogonal to the at least first and second flat surfaces and a direction parallel to the at least first and second flat surfaces.

16. The edge finishing apparatus of claim 13, wherein the first belt comprises multiple first continuous channels and the second belt comprises multiple second continuous channels, and the fluid delivery device is configured to deliver a plurality of MPF ribbons to the first and second continuous channels.

17. The edge finishing apparatus of claim 13, further comprising another magnet disposed adjacent to the at least first and second belts to apply a second magnetic field in a vicinity of the first and second flat surfaces.

18. The edge finishing apparatus of claim 13, comprising two fluid delivery devices, the first fluid deliver device configured to deliver at least one MPF ribbon to the first continuous channel and the second fluid deliver device configured to deliver at least one MPF ribbon to the second continuous channel.

* * * * *